US005211382A

United States Patent [19]

Finlay

[11] Patent Number: 5,211,382

[45] Date of Patent: May 18, 1993

[54] ARROW FLETCHER

[75] Inventor: Robert L. Finlay, Emporia, Kans.

[73] Assignee: BPE, Inc., Emporia, Kans.

[21] Appl. No.: 814,618

[22] Filed: Dec. 30, 1991

[51] Int. Cl.[5] ..... B25B 1/20

[52] U.S. Cl. ..... 269/38; 269/279; 269/63

[58] Field of Search ..... 269/38, 279, 296, 63

[56] References Cited

U.S. PATENT DOCUMENTS

| | | | |
|---|---|---|---|
| 10,985 | 5/1854 | Gregg | 269/279 |
| 2,563,088 | 8/1951 | Wilks et al. | 269/279 |
| 2,869,597 | 1/1959 | Lozon | 269/38 |
| 3,015,483 | 1/1962 | Martin | 269/38 |

OTHER PUBLICATIONS

"BPE Arrow Fletcher with Magnetic Clamp" previously manufactured and sold by the Assignee of this application and as described and depicted in the attached instruction sheet.

"Fletching Jigs" catalog, p. 39, Items J2, J3, J5 and J8.

"Arizona E-Z Fletch" as depicted in attached catalog p. 69.

Fletchers as depicted in the attached catalog p. 28 identified with Bow hunter's Warehouse, Inc.

Fletching Jig and Clamp Model GOP 160 as depicted in attached catalog page.

"J-15 Fletching Jig" as depicted on attached catalog page U.S. Pat. No. 4,867,426, as referred to on the foregoing catalog page.

*Primary Examiner*—Robert C. Watson

*Attorney, Agent, or Firm*—Hovey, Williams, Timmons & Collins

[57] ABSTRACT

An arrow fletcher for use in supporting an arrow shaft having a nock and holding a fletching proximate the shaft is provided which includes a frame, an shaft support and an indexing head including a nock receiver. The shaft support may include a plurality of discretely sized openings therein for receiving any one of a plurality of differently sized arrow shafts in alignment with the nock receiver. Preferably, the shaft support is rotatably mounted to the frame so that differently sized openings may be brought into position by rotating the shaft support. The indexing head includes a plurality of selectively positionable pointers and indicia located on the body of the indexing head for identifying the angular relationship between the nock of the arrow and the fletching placements. The nock receiver is preferably adjustable relative to the indexing head body whereby the angular relationship between the nock and the fletchings may be changed. The frame may be coupled to a base for supporting on a supporting surface, and a mounting bracket may be coupled to the base for permitting the base to be readily removed from the supporting surface but securely held in position when coupled to the mounting bracket.

16 Claims, 2 Drawing Sheets

Fig.1.
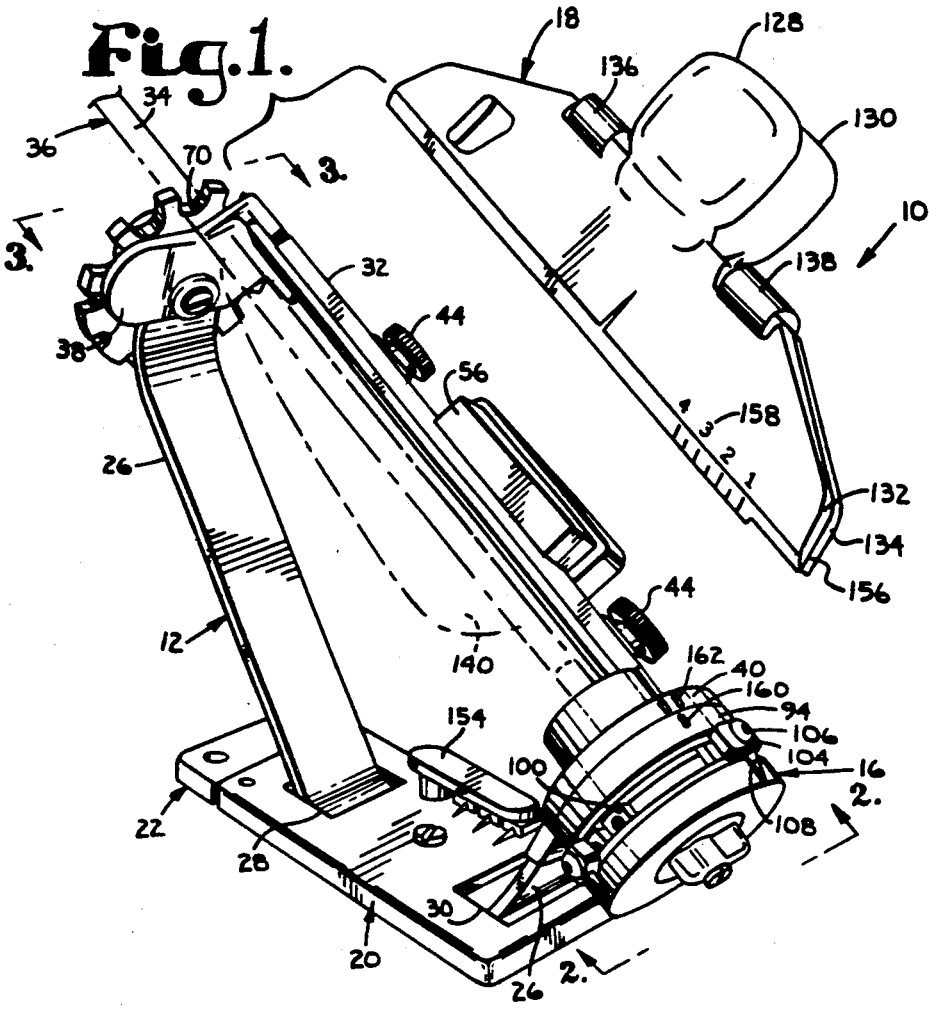
Fig.2.
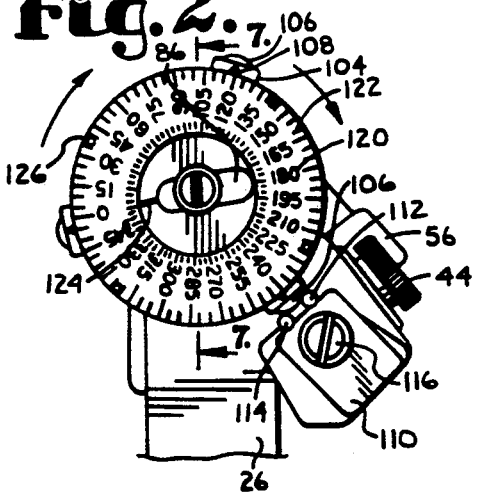
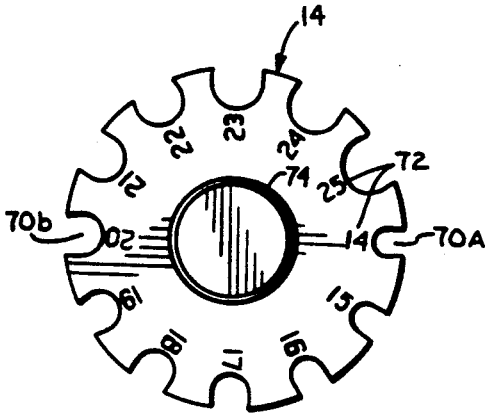
Fig.3.

ARROW FLETCHER

BACKGROUND OF THE INVENTION

1. Field of the Invention

This invention relates to arrow fletchers of the type having a frame, a shaft support, a nock receiver and a clamp for holding a fletching adjacent the arrow shaft. More particularly, the present invention is addressed to an arrow fletcher capable of securely holding arrow shafts of different diameters, having an indexing head for locating fletchings at desired angular relationships about the shaft, and having a base quickly detachable from a mounting bracket coupled to a supporting surface.

2. Description of the Prior Art

Archery is receiving ever increasing popularity as a sport. The recent development of new technology in the fields of bows, sighting instruments and arrow supports has increased the accuracy of archers and lowered the cost of participation in the sport. At the same time, the fletching of arrows as both a hobby and a vocation has experienced significant growth. Fletching involves the attachment of the feathers or vanes to the arrow to stabilize its flight.

While many archers are content to purchase standard arrows already fletched from the factory, many have developed an interest in fletching their own arrows. At one time, this could be accomplished with only a limited degree of precision, as the bows and sights of that time correspondingly could only take limited advantage of any precision and consistency in the arrow.

One area of archery technology which has expanded the options of the fletcher is the arrow rest. From arrow rests which initially accommodated only a standard 120° fletching interval with the cock or index fletch extending horizontally, arrow rests now include springs, rollers, trailing arms and other instruments which permit a number of different angular relationships between the fletchings. For example, arrows may now include four fletchings instead of three, or even six fletchings in some applications. Moreover, the precise placement of the fletchings has become more critical as technology has provided for ever more accurate bows and sights. The fletcher receives arrow shafts which are straighter and more evenly balanced, and the fletchings or vanes (fletchings being generally used herein to encompass both feather fletchings as well as solid plastic vanes) are precisely ground and trimmed to provide uniformity.

As a result, a number of arrow fletchers have been developed for holding a fletching in fixed relationship to the shaft. Some of these arrow fletchers hold the shaft on a frame and receive an arrow nock therein with clamps which allow for attaching fletchings individually, while others are jigs which provide a compound clamp for attaching three fletchings at once. In most instances, an opening is provided for holding the shaft. In some instances, a rotatable index head is provided with indexing stops corresponding to pre-determined, non-adjustable fletching locations relative to the shaft. However, to change the fletching set up to provide different spacings, additional fletchings, or to accommodate helical fletchings has proven impossible or required expensive and elaborate conversion kits which were time consuming to install. In addition, there has been an absence of arrow fletchers which provide complete flexibility to the user in choosing his own set up and being able to consistently replicate that set up. Another disadvantage of prior art fletchers has been their difficulty in accurately and securely holding arrow shafts of different diameters in place. An archer may desire shafts of different dimensions for different shooting situations, different bow weights, or other factors of personal preference. Certain "universal" arrow fletchers have a diverging notch which supports the shaft according to its diameter. However, these shaped diverging notches require that the clamp mount be adjusted for each differently sized shaft to properly center the fletching on the shaft.

These diverging notch type fletchers also result in an occasional tendency of the shaft to slide up and out of the notch, resulting in an improper fletch. While some fletchers have a self-centering feature, these are jigs which clamp 3 fletches at the same time and the pre-set clamp angles are fixed. Further, separate, precisely positioned alternate openings are not provided to securely clamp a number of sizes of different arrow shafts. Many of the frame type prior art fletchers are configured to mount directly to a bench or other supporting surface. This provides a degree of rigid support and makes the fletcher easier to use. This is because most fletchers will tip over with a full length shaft and a hunting or practice point. Thus, most arrow fletchers have mounting holes for receiving screws to mount them to a work table or bench. In many cases, the mounting holes are difficult to access, and many users do not want to permanently mount the arrow fletcher to a work bench in order to free the space for alternative use.

SUMMARY OF THE INVENTION

These and other problems have largely been solved by the present invention. That is to say, the arrow fletcher hereof is fully adaptable to mount multiple fletchings on an arrow easily and with precision; to securely hold a variety of different shaft sizes; and quickly attaches and dismounts to a mounting bracket, freeing a work bench for a variety of alternative uses. The present invention is easy to use, allows the desired angle between the nock and the fletchings to be quickly changed, and furthermore permits both helical and straight fletchings to be mounted either straight or at an angle on the shaft. The fletcher broadly includes a frame, a shaft support, an indexing head having a nock receiver, and a clamp for holding a fletching adjacent the shaft of the arrow. The shaft support preferably includes a number of separate openings therein sized to receive arrow shafts of different diameters. The openings are specifically sized so that arrows corresponding to each size of hole can be quickly and securely positioned. Moreover, the shaft support is preferably rotatably mounted so that different openings can be readily placed in alignment with the nock receiver and held there by a detente mechanism between the frame and the rotatable shaft support.

The indexing head hereof is also preferably rotatably mounted to the frame whereby the shaft can be rotated to place the desired portion of the arrow adjacent the clamping mechanism. Advantageously, the indexing head includes a number of selectively positionable pointers which can be adjusted to a broad range of fletching locations. Additionally, the location of the nock of the arrow can be changed relative to the fletching pointers so that different arrow fletching configurations can be readily accommodated. The pointers are preferably mounted around the circumferential outer surface of the indexing head for engagement with a catch mounted on the frame, the catch serving to hold the pointers in position while the fletching is glued onto the shaft. The indexing head further provides indicia thereon so that the user can readily identify the particular fletching configuration. While in accordance with the intent of the present invention a large number of pointers could be accommodated, the present invention includes pointers and attachment couplings sufficient to accommodate up to six fletchings, with their relative position on the head being adjustable. The indexing head is held by a screw or other clamping device to a nock location indicator which is normally rotatable with the indexing head but may be adjusted relative to the indexing head for determining the angle of the fletching points to the nock of the arrow.

The arrow fletcher is preferably provided with a base and a mounting bracket. The mounting bracket is small and unobtrusive, and may be permanently attached to the worktable or other supporting surface by screws or the like. The mounting bracket and the base are alternately provided with a cooperatively configured recess and projection so that the base can be quickly and removably mounted to the bracket during use and then removed for storage, freeing the work surface for other tasks. The base is thus provided with a means of rigidly mounting to the supporting surface which enables it to be mounted and removed without the use of tools.

BRIEF DESCRIPTION OF THE DRAWINGS

FIG. 1 is a perspective view of the arrow fletcher of the present invention showing a fletching clamp exploded away from the frame to show the mounting magnet therefore, and an arrow shown in phantom;

FIG. 2 is an enlarged fragmentary elevation view of the indexing head of the arrow fletcher showing the nock indicator and numerical indicia on the face of the indexing head;

FIG. 3 is an enlarged fragmentary elevation view of the shaft support showing the openings therein sized for receiving differently sized shafts;

DESCRIPTION OF THE PREFERRED EMBODIMENT

Figure 4:
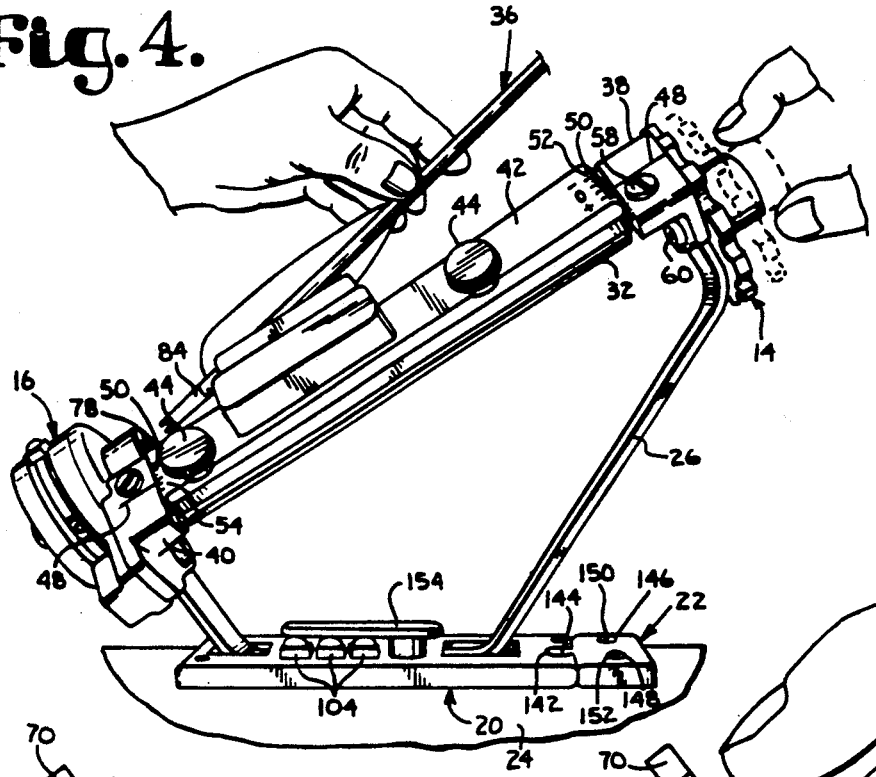
FIG. 4 is a left side perspective view showing the arrow fletcher with a fletched arrow being removed therefrom.

Referring now to the drawing, an arrow fletcher 10 broadly includes a frame 12, a shaft support 14, an index head 16, a fletching clamp 18, a base 20 and a mounting bracket 22. As may be seen in FIG. 4, the arrow fletcher 10 is designed to be mounted onto a supporting surface 24 so that the user is free to employ both hands during the fletching operation.

In greater detail, frame 12 broadly includes a curved supporting bar 26 which is routed through holes 28 and 30 of base 20, and a magnet support beam 32 which extends generally parallel to a shaft 34 of an arrow 36 to be fletched. The magnet support beam 32 is fixed relative to the supporting bar 26 by upper housing 38 and index head housing 40. Thus, support bar 26 is curved and is preferably higher at upper housing 38 in order to present shaft 34 at an angle when received in the arrow fletcher 10.

As seen in FIG. 4, magnet support beam 32 adjustably carries a magnet bar 42 thereon. The magnet support beam 32 is provided with two threaded holes for receiving thumb screws 44 which extend through transversely extending slots provided in magnet bar 42. Both upper housing 38 and index head housing 40 are provided with centering lines 46 and 48 respectively inscribed thereon, while magnet bar 42 is provided with graduation markings 50 at the upper end 52 and the lower end 54 thereon. Magnet bar 42 is thus able to shift laterally relative to magnet support beam 32, the degree of displacement being determinable by the relative alignment between centering lines 46 and 48 and graduation markings 50. Magnet bar 42 carries a permanent magnet 56 between thumb screws 44, the permanent magnet 56 being secured to the magnet bar 42 so that movement of the magnet bar 42 causes corresponding movement of the permanent magnet 56.

Figure 5:
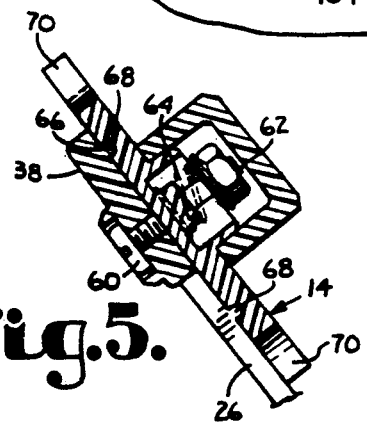
FIG. 5 is a vertical cross-sectional view of the shaft support with a detente associated with the frame in engagement with depression corresponding to an opening on the shaft support.

Upper housing 38 receives screw 58 for connecting to magnet support beam 52. As may be seen in FIGS. 3, 5 and 6, upper housing 38 rotatably mounts shaft support 14 thereon. Shaft support 14 is connected to upper housing 38 by bolt 60 which extends through an opening in upper housing 38 and is secured by a nut 62 holding a spring 64 in compression. Housing 38 includes a detente 66 which is positioned for engagement with a corresponding recess 68 in shaft support 14 as may be seen in FIGS. 5 and 6. A plurality of recesses 68 are provided in circumferentially spaced relationship around shaft support 14, one recess 68 being provided for each opening 70 spaced circumferentially around the shaft support 14. As shown in FIG. 3, the openings 70 are each sized differently to receive an arrow shaft 34 of a different diameter. For example, opening 70A has a width of 14 mm. and thus receives an arrow shaft 34 of a 14 mm. diameter, while opening 70B has a width of 20 mm., and thus is designed to receive an arrow shaft 34 having a diameter of 20 mm. As shown in FIG. 3, indicia 72 are preferably molded into the synthetic resin shaft support 14 whereby the user can readily determine the diameter of each opening 70. A cap 74 is force-fitted over lip 76 in shaft support 14 to cover nut 62 and spring 64; however, cap 74 can be removed to provide access to these components.

Index head housing 48 receives index head 16 for rotation therein. Index head 16 includes a nock receiver 78 including a cross-member 80 which spans the cavity 82 for receiving a nock 84 located on the shaft 34. The nock includes a notch into which cross-member 80 projects and holds the nock 84 (and thus the shaft 34) against rotation relative to the nock receiver. An indicator 86 is provided with a pair of tits 88 which engage corresponding hollows 90 defined in nock receiver 78 so that indicator 86 is rotatably engaged with nock receiver 78. Nock receiver 78 is internally threaded for receiving screw 92 to hold indicator 86 against nock receiver 78.

Index head 16 also includes index body 94 which is held in position against nock receiver 78 by the force applied by screw 92. Index body is provided in two pieces held together by screws 96. A circumscribing slot 96 is defined by index body 94, slot 96 including a channel 98 which loosely receives a plurality of square nuts 100 therewithin. Square nuts 100 are thus shiftable within channel 98 and oriented to threadably receive fletch locator bolt 102, the latter extending through fletch locator 104. Advantageously, fletch locator bolt 102 is provided with a round head 106 for purposes as will be described hereinafter.

Fletch locator 104 includes a pointer 108, best seen in FIG. 1. Locator receiver 110 is positioned adjacent index head 16 whereby a round head 106 of a fletch locator bolt 102 may be received between pins 112 and 114 as shown in FIG. 2. Locator receiver 110 is maintained in position relative to index head housing 40 by screw 116 threaded into index head housing 40. Spring 118 resiliently biases locator receiver 110 against index head housing 40, but permits locator receiver 110 to yield so that round head 106 is releasably held between locator pins 112 and 114.

As may be seen in FIG. 2, index body 94 presents a circular appearance when viewed from the end and includes numerical indicia 120 with corresponding angle markings 122 preferably molded or inscribed therein. Index body 94 is rotatably mounted relative to index head housing 40. Thus, fletch locator bolts 102 may be tightened relative square nuts 100 so that the fletch locator bolts 102 are clamped relative to index head 16 for rotation therewith and do not become dislodged upon engaging locator pins 112 and 114. The pointers 108 are directed toward numerical indicia 120 and angle markings 122 to reflect the relative positioning of fletch locators 104 around index head 16. In addition, indicator 86 is provided with a director 124 molded thereon or inscribed therein which similarly points toward numerical indicia 120 and angle markings 122. In addition, for convenience, nibs 126 may be molded at fixed, desired locations around index head 16 for indicating pre-selected fletching spacings.

Figure 7:
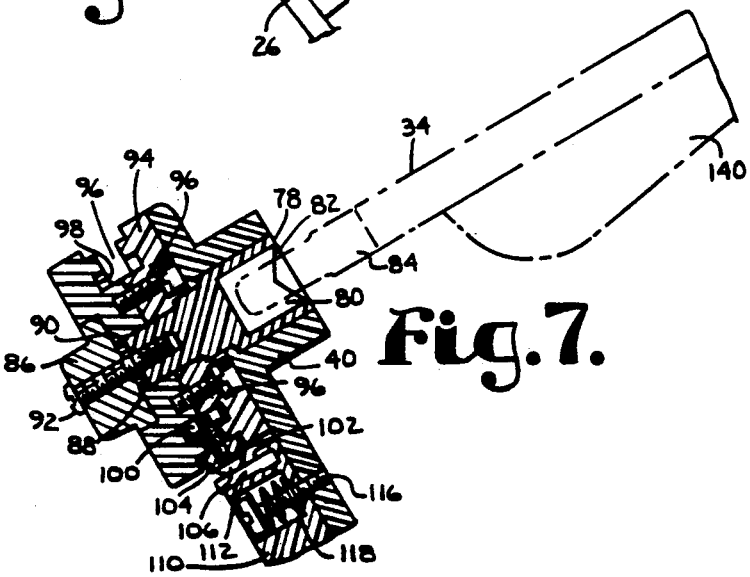
FIG. 7 is a vertical cross-sectional view of the indexing head showing the circumferentially extending slot for receiving the pointers therein.

Clamp 18 is of conventional design and includes graspable tabs 128 and 130 which may be pinched together by the operator's thumb and forefinger to open separable jaws 132 and 134. Jaws 132 and 134 are held together by spring clamps 136 and 138. Additionally, a ferromagnetic surface such as an iron band is affixed to jaw 134 for securing fletching clamp 18 to permanent magnet 56 located on magnet bar 42. Jaws 132 and 134 can be configured for providing either a straight, right-hand or left-hand fletching 140, as shown in phantom in FIGS. 1 and 7.

Base 20 is preferably not secured to supporting surface 24. Instead, it is provided with structure defining a recess 142 complementarily configured to a corresponding projection 144 of mounting bracket 22. Mounting bracket 22 is preferably provided with passages 146 and 148 to receive corresponding mounting screws 150 and 152 therethrough to secure the mounting bracket 22 to the supporting surface 24. Base 20 is provided with suitable grooves to carry a nock-receiver wrench 154 and additional fletch locators 104 therein.

Figure 6:
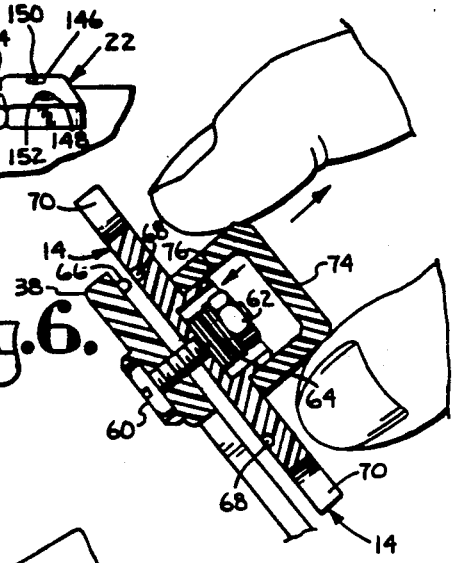
FIG. 6 is a vertical cross-sectional view similar to FIG. 5, showing the shaft support being rotated to bring a different opening into position.

In operation, the user initially positions the rotatable index head 16 relative to the index head housing 40 by locating cock fletch reference mark 160 on index head 16 between centering marks 162 on index head housing 40. The user then selects a shaft 34 of an arrow 36 to be fletched, placing the nock 84 into the nock receiver 78 whereby the nock is prevented from rotating by the cross-member 80. The user has selected a shaft of a particular diameter, and thus pulls outwardly on cap 74 as indicated in FIGS. 4 and 6 to place a correspondingly sized opening 70 in alignment with nock receiver 78. The detente 66 is then seated in a recess 68 to hold the shaft support 14 against undesired rotational movement. The shaft of the arrow is then placed into the selected opening 70 as shown in FIG. 1.

In order to attach a fletching 140 to the shaft 34, the fletching is first clamped by fletching clamp 18. The fletching clamp 18 is then magnetically secured to permanent magnet 56 and preferably, for consistency of alignment, the rearmost end 156 of fletching clamp 18 is moved rearwardly into engagement with nock receiver 78 of index head 16. As may be seen in FIG. 1, fletching clamp 18 is preferably provided with fletch alignment indicia 158 so that the fletchings are consistently positioned in a fore and aft direction along shaft 34.

The operator also loosens fletch locator bolts 102 by inserting an allen wrench into round head 106 to loosen the gripping engagement on index body 94 and move square nut 100, fletch locator bolt 102, and fletch locator 104 circumferentially around index body 94 to the appropriate location evidenced by numerical indicia 120 and angle markings 122. The number and location of the fletch locators 104 may be varied as desired by the user. For example, if the operator desires to utilize a 60° by 120° pattern using four fletches, the fletch locators 104 are set so that their pointers 108 point to the 0°, 120°, 180° and 300° numerical indicia 120 on index head 16. For this pattern, the user would then loosen screw 92 and shift indicator 86 relative to index body 94 so that director 124 points to the proper location for the desired fletching. For example, when a straight fletching is to be used, director 124 should point to the numerical indicia 120 indicating "90°", while if a left helical fletching clamp 18 is used, the director 124 should point toward the 205° numerical indicia 120. The following table illustrates a representative sample of fletching patterns which might be employed:

| | | | Set Director (124) to Numerical Indicia (120) | | |
|---|---|---|---|---|---|
| No. of Fletches | Fletch Angles | Set Pointers To | Straight | Right Helical | Left Helical |
| 3 | 120° Cock Fletch Out | 0°-120°-240° | 0° | 0° | 0° |
| 3 | 120° Cock Fletch Down | 0°-120°-240° | 90° | 90° | 90° |
| 4 | 75° × 105° | The 4 Nibs (126) | 90° | 90° | 90° |
| 4 | 60° × 120° | 0°-120°-180°-300° | 0° | | |
| 4 | 90° × 90° Cock Fletch 45° | 0°-90°-180°-270° | 45° | 45° | 45° |
| 5 | 5 Fletch - Cock Fletch Down | 0°-72°-144°-216°-288° | 90° | | |
| 6 | FLU FLU | 0°-60°-120°-180°-240°-300° | 0° | | |

In order to change the angle of the cross-member 80 (and thus the nock 84 of the arrow 36) relative to the index head 16 (and thus the fletching 140), wrench 154 having a slot therein is placed in the cavity 82 of the nock receiver 78 and a screwdriver is used to loosen the screw 92 one-half turn, thereby enabling the user to rotate the nock receiver 78 relative to the index body 94 so that the director 124 is repositioned to point to the desired number of degrees of the angle markings 122 and numerical indicia 120. The user then retightens screw 92, making sure the director 124 does not move during relative to the index body 94 during the retightening process.

To change the angle of the fletching, fletch locator bolts 102 are loosened so that fletch locator bolts 102 together with the square nuts 100 and the fletch locators 104 may slide circumferentially around slot 96 until the pointer 108 is set at the desired degree and then tightened using the allen wrench until the fletch locator 104 is snug against the index body 104. In the embodiment shown, up to six fletch locators may be employed around index head 16 by adding additional fletch locators 104 stored in base 20, although it is to be understood that the scope of the invention is not so limited.

With the fletch locators in place, the user rotates index head 16 until round head 106 is lodged between locator pins 112 and 114 as shown in FIG. 2. This thus places the shaft in position for receiving a first fletching 140 thereon. The user makes a trial alignment of the fletching 140 to be installed by placing the fletching clamp 18 holding a fletching 140 therein adjacent the shaft 34. If the clamp is not properly aligned on the arrow shaft, thumb screws 44 may be loosened and magnet bar 42 shifted until the proper alignment is achieved. Thumb screws 44 are the retightened and then fletching clamp 18 is removed. The user then applies a thin line of glue along the fletching 140 to be applied and repositions the fletching clamp 18 on the permanent magnet 56 until the glue is dry. The user then removes the fletching clamp 18, rotates the index head 16 until the round head 106 of the next fletch locator bolt 102 and fletch locator 104 clicks into position between the locator pins 112 and 114. The gluing process is repeated until all fletchings have been applied.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. An arrow fletcher for use in attaching a fletching to an arrow shaft having a nock, the improvement comprising:

a frame;

a nock receiver attached to said frame;

means coupled to said frame for positioning a fletching adjacent an arrow shaft positioned on said nock receiver; and a shaft support attached to said frame in spaced relationship to said nock receiver, said shaft support presenting a plurality of discretely sized openings for alternately receiving a complimentarily dimensioned arrow shaft therein, said shaft support being configured to allow the removal of the arrow therefrom transverse to an axis of the arrow extending along its shaft.

2. An arrow fletcher as set forth in claim 1, wherein said shaft support is rotatably mounted to said frame.

3. An arrow fletcher as set forth in claim 2, wherein said openings in said shaft support are circumferentially disposed about the outer margin of said shaft support.

4. An arrow fletcher as set forth in claim 2, including means biasing said shaft support toward said frame.

5. An arrow fletcher as set forth in claim 4, said shaft support including indexing means for locating one of said plurality of openings in alignment with said nock receiver.

6. An arrow fletcher as set forth in claim 5, said indexing means including a detente located on one of said frame and said shaft support for engaging a corresponding depression in the other of said shaft support and said frame.

7. An arrow fletcher for use in attaching a fletching to an arrow shaft having a nock, the improvement comprising:

a frame;

a shaft support located at one end of said frame;

means coupled to said frame for positioning a fletching adjacent a shaft located in said support; and an indexing head rotatably mounted to said frame, said indexing head including a nock locator presenting a rib configured for engagement with a slot in the nock of an arrow shaft received in said nock locator, a body rotatably mounted to said frame positioned in substantially surrounding relationship to said nock locator, said body including means selectively positionable thereon for holding said body and said nock locator in corresponding selected angular intervals relative to said fletching positioning means.

8. An arrow fletcher as claimed in claim 7, including a catch mounted to said frame for releasably holding said holding means on said indexing head at said selected angular intervals during rotation of said indexing head relative to said frame.

9. An arrow fletcher as claimed in claim 8, wherein said selectively positionable holding means include pointers releasably secured to said indexing head for engagement with said catch.

10. An arrow fletcher as claimed in claim 9, said head presenting a circumscribing slot for receiving said pointers at selectable positions therearound.

11. An arrow fletcher as claimed in claim 10, including a plurality of pointer attachment couplings shiftably received in said circumscribing slot.

12. An arrow fletcher as claimed in claim 7, wherein said nock locator includes fletch locating indicia on said body and said nock locator is provided with indicator means for indicating the relative angular relationship between the nock locator and the fletch locating indicia on said body.

13. An arrow fletcher as claimed in claim 12, including means for releasably clamping said nock locator to said body whereby said nock locator can be adjusted for selective positioning relative to said body.

14. An arrow fletcher as claimed in claim 7, including indicia comprising a plurality of numerals corresponding to measurements in degrees about said body.

15. An arrow fletcher for use in attaching a fletching to an arrow shaft having a nock, the arrow fletcher being supported on a supporting surface, the improvement comprising:

a frame;

a shaft support attached to said frame;

a nock receiver attached to said frame;

means connected to said frame for clamping a fletching to a shaft located in said shaft support;

a base coupled to said frame and configured to be supported by said supporting surface; and a locating bracket for coupling to said supporting surface, one of said locating bracket and said base including a projection and the other of said locating bracket and base including a recess complimentarily configured with said projection for rigidly connecting the base to the locating bracket without the use of tools.

16. An arrow fletcher as claimed in claim 15, wherein said projection and said recess are oriented on said one and the other of said bracket and base for substantially vertically mounting the base downward onto the bracket for resisting lateral movement and removably supporting said base on said supporting surface.

* * * * *